US009988235B2

(12) United States Patent
Oshiro

(10) Patent No.: US 9,988,235 B2
(45) Date of Patent: Jun. 5, 2018

(54) SHEET FOLDING MECHANISM AND SHEET PROCESSING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Toshiaki Oshiro, Izu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 188 days.

(21) Appl. No.: 15/002,602

(22) Filed: Jan. 21, 2016

(65) Prior Publication Data

US 2017/0212461 A1 Jul. 27, 2017

(51) Int. Cl.

| | |
|---|---|
| ***B65H 45/18*** | (2006.01) |
| ***G03G 15/00*** | (2006.01) |
| ***B65H 45/30*** | (2006.01) |
| ***B41L 43/06*** | (2006.01) |
| ***B65H 45/16*** | (2006.01) |
| ***B65H 45/04*** | (2006.01) |
| ***B31F 1/08*** | (2006.01) |
| ***B31F 1/10*** | (2006.01) |

(52) U.S. Cl.

CPC ..... *B65H 45/18* (2013.01); *B31F 1/08* (2013.01); *B31F 1/10* (2013.01); *B41L 43/06* (2013.01); *B65H 45/04* (2013.01); *B65H 45/16* (2013.01); *B65H 45/30* (2013.01); *G03G 15/6529* (2013.01); *G03G 15/6544* (2013.01); *B65H 2404/111* (2013.01); *B65H 2404/1344* (2013.01); *B65H 2511/212* (2013.01); *B65H 2511/224* (2013.01); *B65H 2515/34* (2013.01); *B65H 2801/27* (2013.01); *G03G 2215/00827* (2013.01); *G03G 2215/00877* (2013.01)

(58) Field of Classification Search

CPC ..... B31B 1/52; B31B 1/56; B31F 1/08; B31F 1/10; B41L 43/06; B65H 45/04; B65H 45/16; B65H 45/18; B65H 45/30

USPC ..... 270/32; 493/424, 434, 435, 442, 443, 493/444, 445

See application file for complete search history.

(56) References Cited

U.S. PATENT DOCUMENTS

| | | | | |
|---|---|---|---|---|
| 5,876,027 | A * | 3/1999 | Fukui | B65H 45/18 270/51 |
| 7,722,021 | B2 | 5/2010 | Sasahara | |
| 7,726,638 | B2 * | 6/2010 | Itagaki | B65H 45/18 270/20.1 |
| 7,744,073 | B2 | 6/2010 | Iguchi et al. | |
| 7,850,156 | B2 | 12/2010 | Iguchi et al. | |

(Continued)

*Primary Examiner* — Leslie A Nicholson, III

(74) *Attorney, Agent, or Firm* — Amin, Turocy & Watson LLP; Gregory Turocy

(57) ABSTRACT

According to an embodiment, a sheet folding apparatus comprises a first roller, a second roller configured to be energized to the first roller, form a nip section together with the first roller, fold a sheet in half together with the first roller through the nip section and convey the sheet folded in half together with the first roller and a pressing force adjusting mechanism configured to be capable of increasing and decreasing a pressing force generated at the nip section. The pressing force adjusting mechanism causes a pressing force in a state of being conveying the sheet folded in half to be lower than that in a state of being folding the sheet in half.

8 Claims, 7 Drawing Sheets

(56) References Cited

U.S. PATENT DOCUMENTS

| | | | | |
|---|---|---|---|---|
| 7,922,161 | B2 | 4/2011 | Iguchi et al. | |
| 7,942,396 | B2 | 5/2011 | Iguchi et al. | |
| 7,997,571 | B2 | 8/2011 | Iguchi et al. | |
| 8,028,980 | B2 * | 10/2011 | Fukasawa | B65H 45/18 270/32 |
| 9,321,292 | B2 * | 4/2016 | Morita | B42C 1/12 |
| 2004/0104525 | A1 * | 6/2004 | Suzuki | B65H 37/04 270/32 |
| 2009/0258774 | A1 * | 10/2009 | Suzuki | B31F 1/0012 493/442 |

* cited by examiner

SHEET FOLDING MECHANISM AND SHEET PROCESSING APPARATUS

FIELD

Embodiments described herein relate generally to a sheet folding mechanism and a sheet processing apparatus.

BACKGROUND

A post-processing apparatus is known which carries out a post-processing for a sheet conveyed from an image forming apparatus. The post-processing apparatus is provided with a sheet folding mechanism for folding a sheet bundle in half. The sheet folding mechanism comprises a first roller, a second roller and a folding member. The second roller is energized to the first roller. The second roller and the first roller form a nip section therebetween together. The folding member pushes a sheet bundle into the nip section. The second roller and the first roller fold the sheet bundle in half together through the nip section and then convey the sheet bundle folded in half to a discharging section. For example, the first roller is driven by a drive section provided with a motor to rotate. The second roller rotates with the rotation of the first roller.

Incidentally, in the sheet folding mechanism, it is needed to apply a pressing force with a magnitude by means of which a sheet bundle can be folded in half to the nip section. For example, as a method for applying a pressing force large enough to enable a sheet bundle to be folded in half to the nip section, a spring energizes the second roller towards the first roller. With the use of the spring energization, the pressing force of the nip section can be usually kept at a constant with which a sheet bundle can be folded in half. On the other hand, the pressing force of the nip section at the time of conveyance of a sheet bundle can be small as long as the pressing force is enough to convey the sheet bundle folded in half. However, if kept at a constant with which a sheet bundle can be folded in half, the pressing force of the nip section when the sheet bundle folded in half is conveyed may be excessively large. As a consequence, the sheet bundle folded in half may suffer a too large conveyance resistance when being conveyed, thus leading to problems such as the high power consumption of a motor.

DETAILED DESCRIPTION

In accordance with an embodiment, a sheet folding mechanism comprises a first roller, a second roller and a pressing force adjusting mechanism. The second roller is energized to the first roller, forms a nip section together with the first roller, folds a sheet in half together with the first roller through the nip section and conveys the sheet folded in half together with the first roller. The pressing force adjusting mechanism can increase and decrease the pressing force generated at the nip section. The pressing force adjusting mechanism causes a pressing force in a state of being conveying the sheet folded in half to be lower than that in a state of being folding the sheet in half.

The sheet processing apparatus of the embodiment is described below with reference to the accompanying drawings in which identical elements are denoted by identical reference signs.

Figure 1:
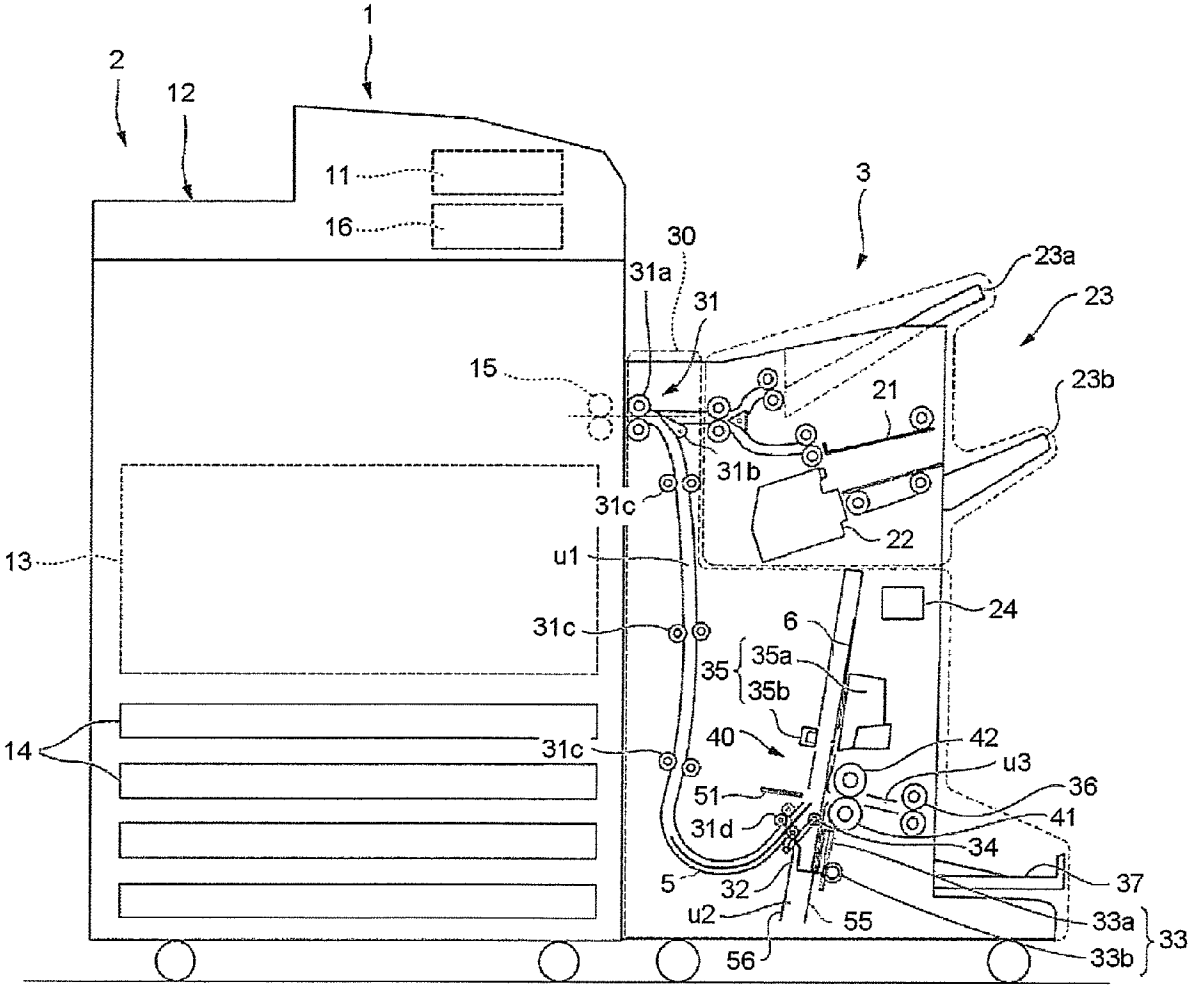
FIG. 1 is a front view exemplifying the overall structure of an image forming system according to an embodiment.
Figure 2:
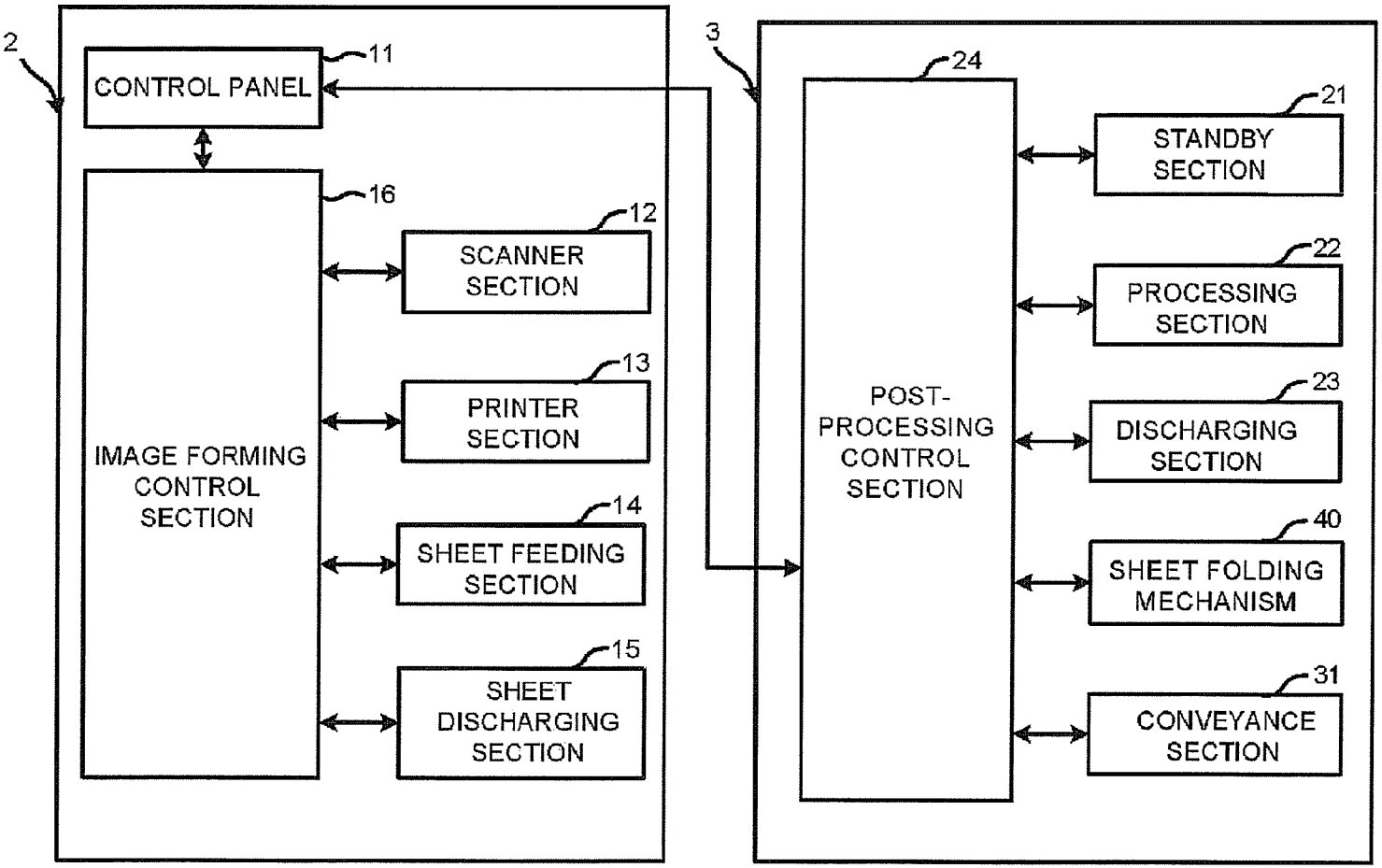
FIG. 2 is a block diagram exemplifying the overall structure of the image forming system according to the embodiment.

FIG. 1 and FIG. 2 exemplify the overall structure of an image forming system 1 according to the embodiment. As shown in FIG. 1 and FIG. 2, the image forming system 1 comprises an image forming apparatus 2 and a post-processing apparatus 3.

The image forming apparatus 2 forms an image on a sheet-like medium (hereinafter referred to as a 'sheet') such as a paper. The image forming apparatus 2 is provided with a control panel 11, a scanner section 12, a printer section 13, a sheet feeding section 14, a sheet discharging section 15 and an image formation control section 16.

The control panel 11 is equipped with various keys for the user to operate. For example, the control panel 11 receives an input relating to the category of a post-processing to be executed on a sheet. The control panel 11 sends the input information relating to the category of the post-processing to be executed on the sheet to the post-processing apparatus 3.

The scanner section 12 comprises a reading section for reading image information of a copied object. The scanner section 12 sends the read image information to the printer section 13.

The printer section 13 forms an output image (hereinafter referred to as a "toner image") with a developing agent such as a toner according to the image information sent from the scanner section 12 or an external device. The printer section 13 transfers the toner image onto the surface of a sheet. The printer section 13 applies heat and pressure to the toner image transferred on the surface of the sheet to fix the toner image on the sheet.

The sheet feeding section 14 feeds sheets, one by one, to the printer section 13 in accordance with a timing at which the printer section 13 forms the toner image.

The sheet discharging section 15 conveys the sheet discharged from the printer section 13 to the post-processing apparatus 3.

The image formation control section 16 controls the whole operations of the image forming apparatus 2. That is, the image formation control section 16 controls the control panel 11, the scanner section 12, the printer section 13, the sheet feeding section 14 and the sheet discharging section 15. The image formation control section 16 consists of a control circuit including a CPU, a ROM and a RAM.

Next, the post-processing apparatus 3 is described below.

The post-processing apparatus 3 is an example of 'a sheet processing apparatus'. The post-processing apparatus 3 is located nearby the image forming apparatus 2. The post-processing apparatus 3 carries out a post-processing designated through the control panel 11 for a sheet conveyed from the image forming apparatus 2. The post-processing apparatus 3 comprises a folding processing section 30 and a post-processing control section 24.

The post-processing apparatus 3 further comprises a standby section 21, a processing section 22 and a discharging section 23.

The standby section 21 temporarily retains (buffers) a sheet 5 conveyed from the image forming apparatus 2. For example, the standby section 21 keeps a plurality of succeeding sheets 5 waiting during the period the processing section 22 carries out a post-processing for the current sheet 5. If the processing section 22 is empty, the standby section 21 makes a retained sheet 5 fall towards the processing section 22.

The processing section 22 carries out a post-processing for the sheet 5. The post-processing refers to a stapling processing or a sorting processing. For example, the processing section 22 aligns a plurality of sheets 5. The processing section 22 staples the plurality of aligned sheets 5. The plurality of sheets 5 are bundled through the stapling processing. The processing section 22 discharges the sheets 5 to which the post-processing is carried out to the discharging section 23.

The discharging section 23 comprises a fixed tray 23*a* and a movable tray 23*b*. The fixed tray 23*a* is arranged on the upper part of the post-processing apparatus 3. The movable tray 23*b* is arranged on a lateral part of the post-processing apparatus 3. The sorted sheets 5 are discharged into the movable tray 23*b*.

A folding processing section 30 folds a sheet 5 in half. The folding processing section 30 comprises a sheet folding mechanism 40, a conveyance section 31, a stacker 32, a stacker moving mechanism 33, a loading assisting roller 34, a saddle-stitching mechanism 35, a discharging roller 36 and a loading tray 37.

The conveyance section 31 comprises an inlet roller 31*a*, a branching member 31*b*, a conveyance roller 31*c* and a carry-out roller 31*d*.

The inlet roller 31*a* carries in a sheet 5 conveyed from the image forming apparatus 2 into the post-processing apparatus 3.

The branching member 31*b* switches conveyance paths according to a post-processing executed on the sheet 5. The branching member 31*b* switches conveyance paths so as to make the sheet 5 conveyed to the side of the standby section 21 or to the side of the sheet folding mechanism 40.

The conveyance roller 31*c* conveys the sheet 5 along a first conveyance path u1. After extending downward temporarily from the inlet roller 31*a*, the first conveyance path u1 is curved to extend upwards slantwise towards the sheet folding mechanism 40.

The carry-out roller 31*d* carries out the sheet to a second conveyance path u2. The second conveyance path u2 is arranged at the downstream side of the first conveyance path u1. The space between a support plate 55 and a top plate 56 facing each other constitutes the second conveyance path u2. The support plate 55 is inclined with respect to the perpendicular direction. The top plate 56 is inclined along the inclined direction of the support plate 55. The top plate 56 is arranged at the side of the first conveyance path u1 with respect to the support plate 55. The second conveyance path u2 is inclined with respect to the perpendicular direction.

The stacker 32 catches the sheet 5 carried out to the second conveyance path u2 from the first conveyance path u1. If carried out to the second conveyance path u2, the sheet 5 falls along the support plate 55 under the effect of dead weight. The stacker 32 catches the front end of the falling sheet 5 in the conveyance direction of the sheet 5 (the falling direction of the sheet 5).

The stacker moving mechanism 33 comprises a rack 33*a* and a pinion 33*b*. Teeth are attached to a plate-shaped rod of the rack 33*a*. The pinion 33*b* is a toothed gear meshed with the rack 33*a*. The stacker 32 is mounted on the rack 33*a*. The stacker 32 moves up and down along the second conveyance path u2 as the pinion 33*b* rotates.

The loading assisting roller 34 arranged on the second conveyance path u2 assists in loading the sheet 5 falling under the effect of dead weight onto the stacker 32. The loading assisting roller 34 retracts to a position (the position indicated by dotted lines shown in FIG. 1) where the conveyance of the sheet 5 is not hindered by the loading assisting roller 34 when the sheet 5 is conveyed (falls) towards the stacker 32. The loading assisting roller 34 moves towards the side of the support plate 55 when the sheet 5 carried out to the second conveyance path u2 falls. After moving to the side of the support plate 55, the loading auxiliary roller 24 rotates to facilitate the loading of the sheet 5 onto the stacker 32 and meanwhile to align the front end of the sheet 5. After the front end of the sheet 5 is caught by the stacker 32, another following sheet 5 is carried out to the second conveyance path u2. Under the operation of the loading assisting roller 34, sheets 5 are successively loaded on the stacker 32.

The saddle-stitching mechanism 35 comprises a saddle-stitching staple 35*a* and an anvil 35*b* which are located opposite to each other across the second conveyance path u2.

The position where the saddle-stitching mechanism 35 carries out a stapling operation is hereinafter referred to as a 'saddle-stitching position', and the position where the sheet folding mechanism 40 adds a fold to a sheet bundle 6 is hereinafter referred to as a 'fold adding position'. 'Saddle-stitching' refers to fixing a sheet bundle 6 formed by a plurality of stacked sheets 5 with wires along the center part of the sheet bundle 6.

The stacker 32 positions the saddle-stitching position and the fold adding position. For example, when a saddle-stitching operation is carried out, the stacker 32 lifts the center part of the sheet bundle 6 to a position opposite to the saddle-stitching position. Then, the anvil 35*b* is moved to the side of the saddle stitching staple 35*a* to staple the sheet bundle 6. After the sheet bundle 6 is stapled, the stacker 32 lowers the stapled part 6*a* (hereinafter referred to as a 'stapled part') of the sheet bundle 6 to a position opposite to the fold adding position. Then, the front end of a folding member 51 is opposite to the stapled part 6*a*. Generally, in order not to hinder the conveyance of a sheet 5, the folding member 51 retracts from the top plate 56 to the side of the first conveyance path u1 (the outer side of the second conveyance path u2). The folding member 51 moves towards the sheet bundle 6 at the time the sheet bundle 6 is to be folded. The folding member 51 pushes the stapled part 6*a* of the sheet bundle 6 to press the sheet bundle 6 into the nip section 40*a*. In this way, the sheet bundle 6 is nipped in the nip section 40*a* and folded in half at the stapled part 6*a*.

The discharging roller 36 is arranged between the sheet folding mechanism 40 and the loading tray 37. The sheet bundle 6 which is folded in half by the sheet folding mechanism 40 in the nip section 40*a* is hereinafter referred to as a 'booklet'. The sheet folding mechanism 40 carries out a folding processing for the sheet bundle 6 to form a booklet.

The booklet is conveyed towards the discharging roller 36 along a conveyance path u3. The discharging roller 36 discharges the conveyed booklet to the loading tray 37. The discharging roller 36 is an example of the 'discharging section'. The booklet discharged from the discharging roller 36 is loaded on the loading tray 37.

The post-processing control section 24 controls the whole operations of the post-processing apparatus 3. As shown in FIG. 2, the post-processing control section 24 controls the standby section 21, the processing section 22, a discharging section 23, the sheet folding mechanism 40 and the conveyance section 31. For example, the post-processing control section 24 consists of a control circuit including a CPU, a ROM and a RAM.

Next, the sheet folding mechanism 40 is described.

Figure 3:
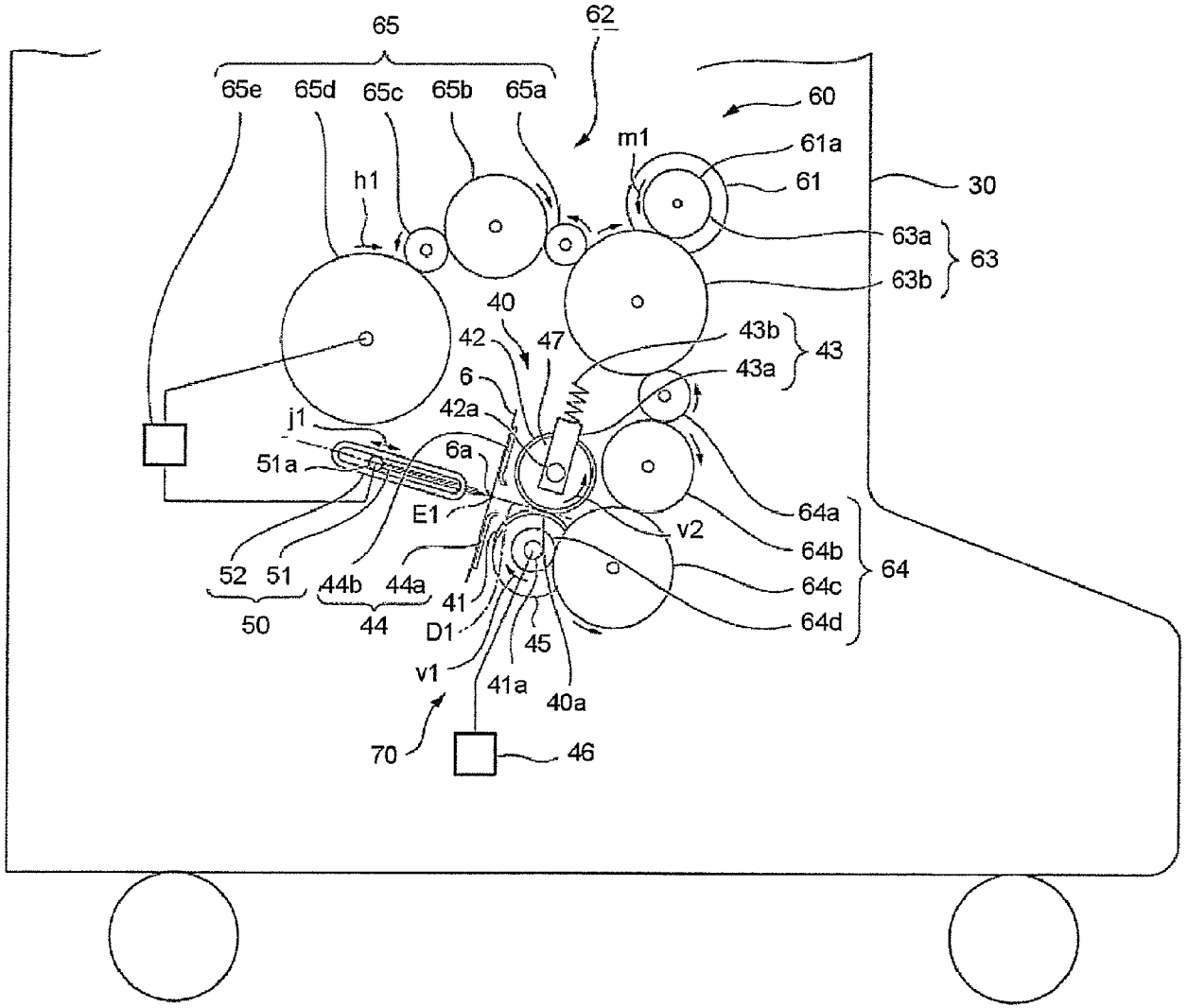
FIG. 3 is a diagram illustrating the general structure of a sheet folding mechanism according to the embodiment.

As shown in FIG. 3, the sheet folding mechanism 40 comprises a first roller 41, a second roller 42, an energization mechanism 43, a sheet pressing mechanism 50, a drive section 60, a guiding member 44 and a pressing force adjusting mechanism 70.

The first roller 41 includes a first shaft 41*a* that extends in such a way to follow the center shaft of the first roller 41.

The first roller 41 rotates independently. The first roller 41 is fixedly arranged to a frame in the folding processing section 30 (hereinafter referred to as an apparatus frame). That is, the first roller 41 rotates at a fixed position but not move with respect to the apparatus frame.

The second roller 42 is opposite to the first roller 41. The second roller 42 includes a second shaft 42*a* that extends in such a way to follow the center shaft of the second roller 42. The second roller 42*a* extends in such a way to follow the first roller 41*a*. The second roller 42 is energized to the first roller 41 through the energization mechanism 43. The second roller 42 can be connected with and separated from the first roller 41. The second roller 42 rotates with the rotation of the first roller 41. The second roller 42 and the first roller 42 form a nip section 40*a* therebetween together. The second roller 42 and the first roller 41 fold a sheet bundle 6 in half together through the nip section 40*a* and convey the sheet bundle 6 folded in half together.

The energization mechanism 43 comprises an arm section 43*a* and a spring 43*b*.

The arm section 43*a* extends in a direction opposite to the first roller 41 and the second roller 42. One end part of the arm section 43*a* rotatably supports one end part of the second shaft 42*a*. One end part of the spring 43*b* is mounted on the other end part of the arm section 43*a*. The other end part of the spring 43*b* is mounted on the apparatus frame. The spring 43*b* energizes the second roller 42 to the first roller 41 through the arm section 43*a*. The spring 43*b* usually performs an energization operation in the direction in which the second roller 42 is pressed to the first roller 41.

The sheet pressing mechanism 50 comprises the folding member 51 and a guide frame 52.

The folding member 51 is a plate-shaped member having a thickness in the direction opposite to the first roller 41 and the second roller 42. A shaft section 51*a* extending in such a way to follow the first shaft 41*a* is mounted in the folding member 51.

The guide frame 52 extends in a direction of approaching or moving away from the nip section 40*a*. The guide frame 52 slidably supports the shaft section 51*a*.

The drive section 60 comprises a motor 61 and a power transmission mechanism 62.

For example, the motor 61 is a direct-current motor. The power transmission mechanism 62 comprises a first transmission mechanism 63, a second transmission mechanism 64 and a third transmission mechanism 65.

The first transmission mechanism 63 comprises a first toothed gear 63*a* and a second toothed gear 63*b*. The first toothed gear 63*a* and the output shaft 61*a* of the motor 61 are arranged coaxially. The second toothed gear 63*b* is meshed with the first toothed gear 63*a*. The first transmission mechanism 63 transfers the driving force of the motor 61 to the second transmission mechanism 64 and the third transmission mechanism 65.

The second transmission mechanism 64 comprises a first toothed gear 64*a*, a second toothed gear 64*b*, a third toothed gear 64*c* and a fourth toothed gear 64*d* which are meshed with each other. The first toothed gear 64*a*, the second toothed gear 64*b* and the third toothed gear 64*c* are arranged successively up and down from the first transmission mechanism 63 towards the first roller 41. The fourth toothed gear 64*d* is fixed on one end part of the first shaft 41*a*.

The second transmission mechanism 64 transfers the driving force of the motor 61 to the first roller 41 through the first transmission mechanism 63. For example, if the motor 61 rotates in the direction indicated by the arrow ml, then the first roller 41 rotates in the direction indicated by the arrow v1. Through the rotation of the motor 61, the second roller 42 is driven by the first roller 41 to rotate in the direction indicated by the arrow v2.

The third transmission mechanism 65 comprises a first toothed gear 65*a*, a second toothed gear 65*b*, a third toothed gear 65*c*, a fourth toothed gear 65*d* and a power conversion section 65*e*. The first toothed gear 65*a*, the second toothed gear 65*b*, the third toothed gear 65*c* and the fourth toothed gear 65*d* are meshed with each other. The first toothed gear 65*a*, the second toothed gear 65*b*, the third toothed gear 65*c* and the fourth toothed gear 65*d* are parallelly arranged into a curve shape from the first transmission mechanism 63 towards the sheet pressing mechanism 50. The power conversion section 65*e* is connected with the fourth toothed gear 65*d* and the shaft section 51*a*. The power conversion section 65*e* converts the rotation of the fourth toothed gear 65*d* in the direction indicated by the arrow h1 into the reciprocation of the shaft section 51*a* in the direction indicated by the arrow j1 along the guide frame 52. That is, the power conversion section 65*e* moves the folding member 51 along the guide frame 52.

The third transmission mechanism 65 transfers the driving force of the motor 61 to folding member 51 through the first transmission mechanism 63. For example, if the motor 61 rotates in the direction indicated by the arrow ml, then the folding member 51 reciprocates in the direction indicated by the arrow j1. That is, through the driving of the motor 61, the folding member 51 enters the nip section 40*a* to push a sheet bundle 6 into the nip section 40*a* and then retracts from the nip section 40*a*.

The motor 61 serves as a common drive source for the folding member 51 and the first roller 41. Thus, the power transmission mechanism 62 has a simpler structure than a power transmission mechanism in which drive sources are separately arranged for the folding member 51 and the first roller 41.

The guiding member 44 guides the sheet bundle 6 pushed by the folding member 51 towards the nip section 40*a*. The guiding member 44 comprises a first guiding member 44*a* and a second guiding member 44*b*. A connecting line D1 shared by the first roller 41 and the second roller 42 is hereinafter referred to as a 'common connecting line'. The first guiding member 44*a* is arranged at the side of the first roller 41 of the common connecting line D1. The second guiding member 44*b* is arranged at the side of the second roller 42 of the common connecting line D1.

The position E1 where the front end of the folding member 51 pushes the stapled part 6*a* of a sheet bundle 6 when the folding member 51 moves towards the nip section 40*a* is hereinafter referred to as a 'push position'.

The first guiding member 44*a* and the second guiding member 44*b* are separately arranged between the nip section 40*a* and the push position E1. The push position E1 is located on the common connecting line D1.

The first guiding member 44*a* is slidably contacted with the sheet bundle 6 at the side of the first roller 41 so as to guide the sheet bundle 6 pushed by the folding member 51 to the nip section 40*a* by means of the stapled part 6*a* pushed at the push position E1. The end part of the first guiding member 44*a* at the side of the nip section 40*a* is curved towards the nip section 40*a*.

The second guiding member 44*b* is slidably contacted with the sheet bundle 6 at the side of the second roller 42 so as to guide the sheet bundle 6 pushed by the folding member 51 to the nip section 40*a* by means of the stapled part 6*a* pushed at the push position E1. The end part of the second guiding member 44*b* at the side of the nip section 40*a* is curved towards the nip section 40*a*.

As shown in FIG. 1 and FIG. 3, at least one of the first guiding member 44*a* and the second guiding member 44*b* takes the front end of a sheet 5 in the conveyance direction of the sheet 5 which is conveyed by the carry-out roller 31*d* towards the second conveyance path u2. Then, the conveyance direction of the sheet 5 is changed from a direction along the first conveyance path u1 to a direction along the second conveyance path u2. That is, at least one of the first guiding member 44*a* and the second guiding member 44*b* has a function of avoiding a sheet jam that occurs at the time the sheet 5 directly enters the nip section 40*a*. Thus, the sheet 5 carried out by the carry-out roller 31*d* is stacked on the stacker 32 but not enter the nip section 40*a*.

The pressing force adjusting mechanism 70 is described below.

As shown in FIG. 3, the pressing force adjusting mechanism 70 comprises a cam 45, a cam driving section 46 and a rotation member 47.

The cam 45 is a plate-shaped cam having a thickness in a direction along the first shaft 41*a*. The cam 45 switches a relative position between the first roller 41 and the second roller 42. Herein, 'switching the relative position' refers to switching an interval between the first roller 41 and the second roller 42. In the embodiment, the interval between the first roller 41 and the second roller 42 is switched in a state in which the first roller 41 is kept at a fixed position. The "interval between the first roller 41 and the second roller 42" is equivalent to the distance between the shaft of the first roller 41 and the shaft of the second roller 42. The cam driving section 46 drives the cam 45 to rotate around the first shaft 41*a*. The cam 45 rotates around the same axis as the first roller 41. The cam 45 rotates independently from the first roller 41.

The rotation member 47 is a disk-shaped member having a thickness in a direction along the second shaft 42*a*. The rotation member 47 rotates around the same axis as the second roller 42. The rotation member 47 rotates independently from the second roller 42. The outer diameter of the rotation member 47 is smaller than that of the second roller 42.

The pressing force adjusting mechanism 70 can increase or decrease the pressing force generated at the nip section 40*a*. A state in which the sheet bundle 6 is being folded in half is hereinafter referred to as a ' sheet folding state' and a state in which the sheet bundle 6 folded in half is being conveyed as a 'sheet conveying state'. The pressing force applied in the sheet conveying state is adjusted by the pressing force adjusting mechanism 70 to be lower than that applied in the sheet folding state.

A state in which the folding member 51 is entering the nip section 40*a* is hereinafter referred to as a 'folding member entering state' and a state in which the folding member 51 is retracting from the nip section 40*a* as a ' folding member retracting state.' The pressing force applied in the folding member retracting state is adjusted by the pressing force adjusting mechanism 70 to be lower than that applied in the folding member entering state.

The relative position switched by the pressing force adjusting mechanism 70 includes a pressing force increase position and a pressing force decrease position. The pressing force increase position is a position where the pressing force is increased relatively. The pressing force decrease position is a position where the pressing force is decreased relatively.

Hereinafter, the pressing force increase position and the pressing force decrease position are described supplement ally.

The pressing force generated at the nip section 40*a* is changed according to the foregoing operation states, that is, the sheet folding state, the sheet conveying state, the folding member entering state and the folding member retracting state. The pressing force generated at the nip section 40*a* is changed according to the thickness of the member nipped in the nip section 40*a* (hereinafter referred to as a 'nipped member'). The pressing force increase position and the pressing force decrease position are changed according to the difference of the operation state and the magnitude of the thickness of the nipped member. It is assumed that at the pressing force increase position and the pressing force decrease position, the operation states are the same and the nipped members have the same thickness (under the same condition). Thus, the pressing force increase position means a position where the interval between the first roller 41 and the second roller 42 (the distance between the shaft of the first roller 41 and the shaft of the second roller 42) is relatively small. On the other hand, the pressing force decrease position means a position where the interval between the first roller 41 and the second roller 42 (the distance between the shaft of the first roller 41 and the shaft of the second roller 42) is relatively large.

Figure 4:
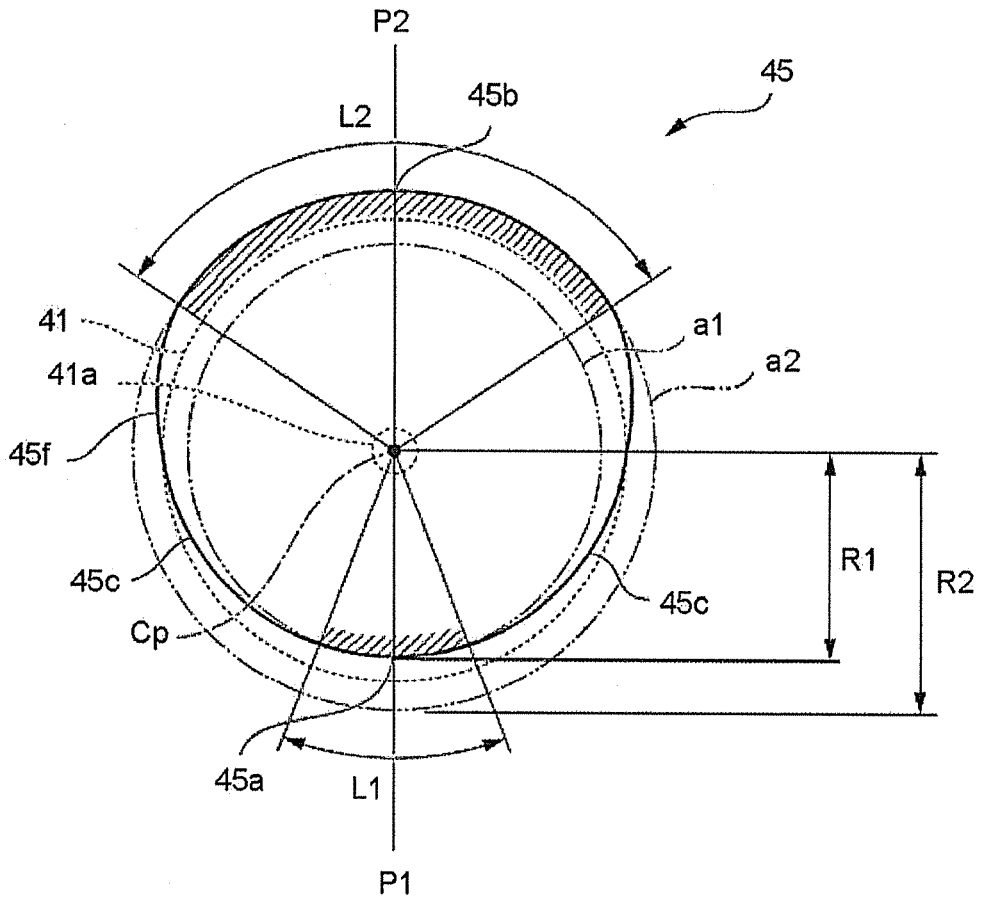
FIG. 4 is an illustration diagram illustrating a cam according to the embodiment.

For the sake of convenience, a plurality of (two, in the embodiment) virtual circles (a first virtual circle a1 and a second virtual circle a2) are shown in FIG. 4 which take the rotation axis Cp of the cam 45 as their centers. Further, the first roller 41 and the first shaft 41*a* are indicated by dotted lines in FIG. 4.

As shown in FIG. 4, observed from the direction along the rotation axis Cp, the first virtual circle a1 and the second virtual circle a2 are set as concentric circles. The first virtual circle a1 is set as the base circle of the cam 45. The first virtual circle a1 has a first radius R1 smaller than that of the first roller 41. The second virtual circle a2 has a second radius R2 greater than the first radius R1. The second radius R2 is greater than that of the first roller 41.

Further, a cam position is shown in FIG. 4 where the relative position switched by the pressing force adjusting mechanism 70 is set. The 'cam position' here refers to the position of a cam surface 45*f* that is changed through the rotation of the cam 45 around the rotation axis Cp. The cam position includes a first cam position P1 and a second cam position P2. The first cam position P1 is assumed as a position where the pressing force increase position is set. The second cam position P2 is assumed as a position where the pressing force decrease position is set.

The cam 45 is described below.

As shown in FIG. 4, the cam 45 has a cam surface 45*f* which is a smoothly continuous surface in the rotation direction of the cam 45. The cam 45 comprises a first position regulation section 45*a*, a second position regulation section 45*b* and a position change section 45*c*. The first position regulation section 45*a* and the second position regulation section 45*b* are arranged at an interval in the rotation direction of the cam 45.

The first position regulation section 45*a* sets the pressing force increase position. Observed from the direction along the rotation axis Cp, the first position regulation section 45*a* is overlapped with the first cam position P1 on the first virtual circle a1. Observed from the direction along the rotation axis Cp, the first position regulation section 45*a* is curved inwards along the first virtual circle a1 into a convex on the outer peripheral side of the cam 45.

The second position regulation section 45*b* is arranged on the cam 45 and located on the opposite side of the first position regulation section 45*a*. The line segment connecting the first position regulation section 45*a* with the second position regulation section 45*b* constitutes the long axis of the cam 45. The second position regulation section 45*b* sets the pressing force decrease position. Observed from the direction along the rotation axis Cp, the second position regulation section 45*b* is overlapped with the second cam position on the second virtual circle a2. Observed from the direction along the rotation axis Cp, the second position regulation section 45*b* is curved inwards along the second virtual circle a2 into a convex on the outer peripheral side of the cam 45.

The length L1 of the first position regulation section 45*a* in the circumferential direction of the cam 45 is smaller than the length L2 of the second position regulation section 45*b* in the circumferential direction of the cam 45 (L1<L2).

The position change section 45*c* is located between the first position regulation section 45*a* and the second position regulation section 45*b* in the rotation direction of the cam 45. Observed from the direction along the rotation axis Cp, the position change section 45*c* is located between the first virtual circle a1 and the second virtual circle a2. Observed from the direction along the rotation axis Cp, the position change section 45*c* is curved into a convex on the outer peripheral side of the cam 45.

The operations of the sheet folding mechanism 40 are exemplified below. For the sake of convenience, the cam 45 and the rotation member 47 are indicated by dotted lines in FIG. 5-FIG. 7.

Figure 5:
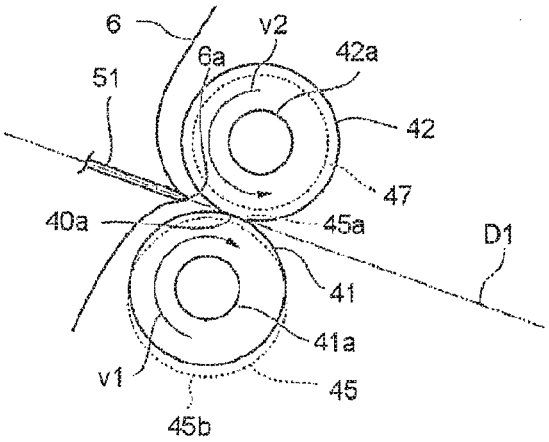
FIG. 5 is an illustration diagram illustrating the operations of the sheet folding mechanism according to the embodiment.
Figure 8:
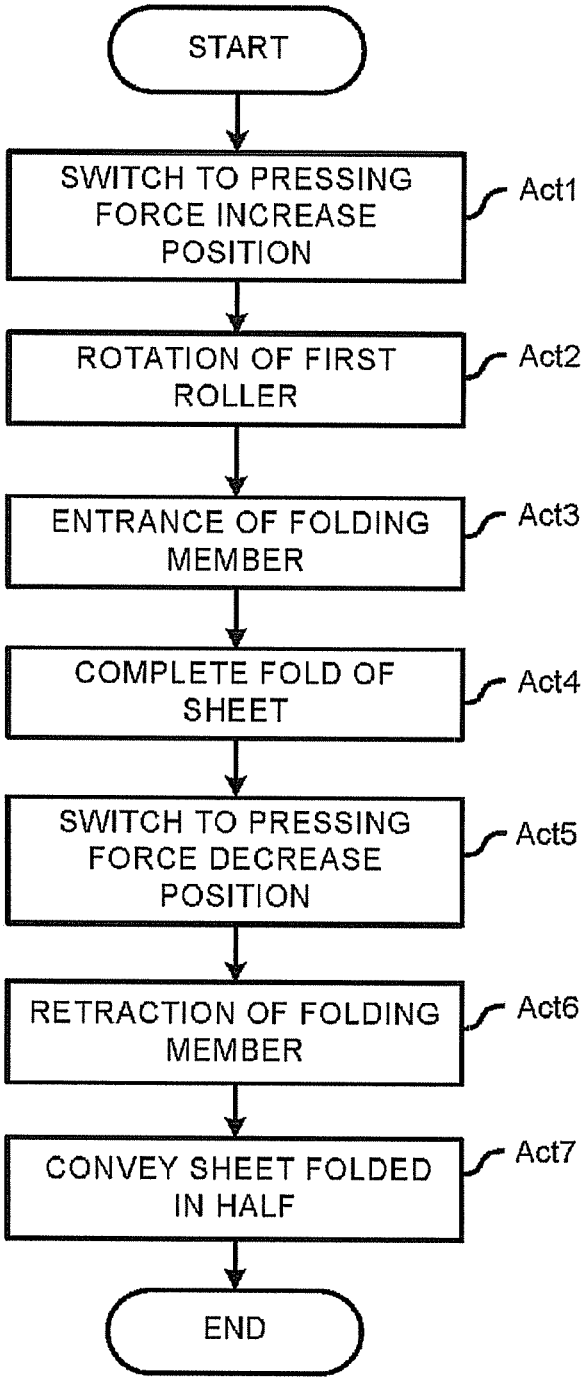
FIG. 8 is a flowchart exemplifying the operations of the sheet folding mechanism according to the embodiment.

As shown in FIG. 5 and FIG. 8, in Act 1, the pressing force adjusting mechanism 70 switches the relative position to the pressing force increase position. For example, the first position regulation section 45*a* of the cam 45 is adjusted to be opposite to the rotation member 47.

In Act 2, the drive section 60 rotates the first roller 41. Then, the second roller 42 is rotated under the drive of the first roller 41.

Figure 6:
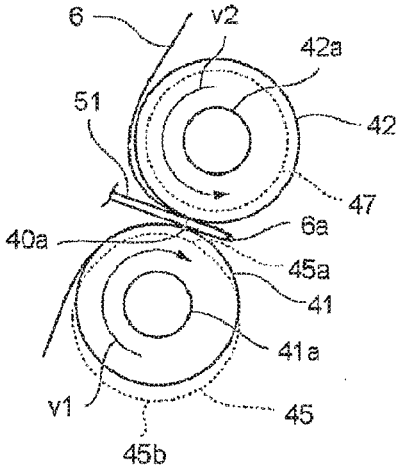
FIG. 6 is an illustration diagram illustrating the operations of the sheet folding mechanism following that shown in FIG. 5.

In Act 3, the folding member 51 enters the nip section 40*a*. Then, the front end of the folding member 51 pushes the stapled part 6*a* of the sheet bundle 6. As shown in FIG. 6, if moved further towards the nip section 40*a*, the folding member 51 pushes the sheet bundle 6 into the nip section 40*a*. As the second roller 42 is pressed against the first roller 41, the pressing force applied in the folding member entering state is larger than that applied in the folding member retracting state. Compared with the pressing force applied in the folding member retracting state, the pressing force applied in the folding member entering state is increased only at a portion corresponding to the thickness obtained by adding the thickness of the folding member 51 and the thickness of the sheet bundle 6 folded in half. That the sheet bundle 6 is folded in half is completed through the pressure connection of the second roller 42 and the first roller 41 and the entrance of the folding member 51 into the nip section 40*a* (refer to Act 4).

Figure 7:
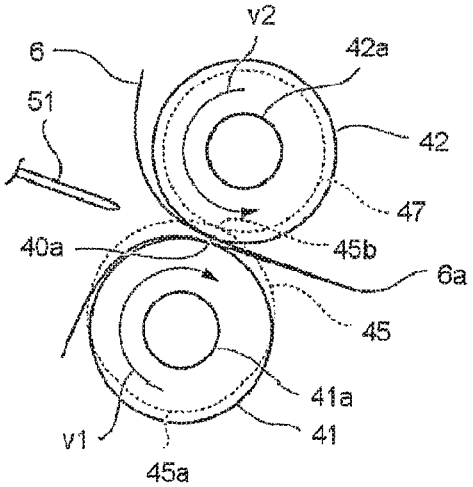
FIG. 7 is an illustration diagram illustrating the operations of the sheet folding mechanism following that shown in FIG. 6.

As shown in FIG. 7 and FIG. 8, in Act 5, the pressing force adjusting mechanism 70 switches the relative position to the pressing force decrease position. For example, the second position regulation section 45*b* of the cam 45 is abutted against the rotation member 47. As a result, the pressing force applied in the sheet conveying state is smaller than that applied in the sheet folding state.

In Act 6, the folding member 51 retracts from the nip section 40*a*. The pressing force applied in the folding member retracting state is lower than that applied in the folding member entering state.

In Act 7, the first roller 41 and the second roller 42 convey the sheet bundle 6 folded in half. By repeating the operations in Act 1-Act 7, the sheet folding mechanism 40 continuously folds sheet bundles 6. As shown in FIG. 1, a booklet obtained by folding a sheet bundle 6 is discharged to the loading tray 37 by the discharging roller 36.

Figure 9:
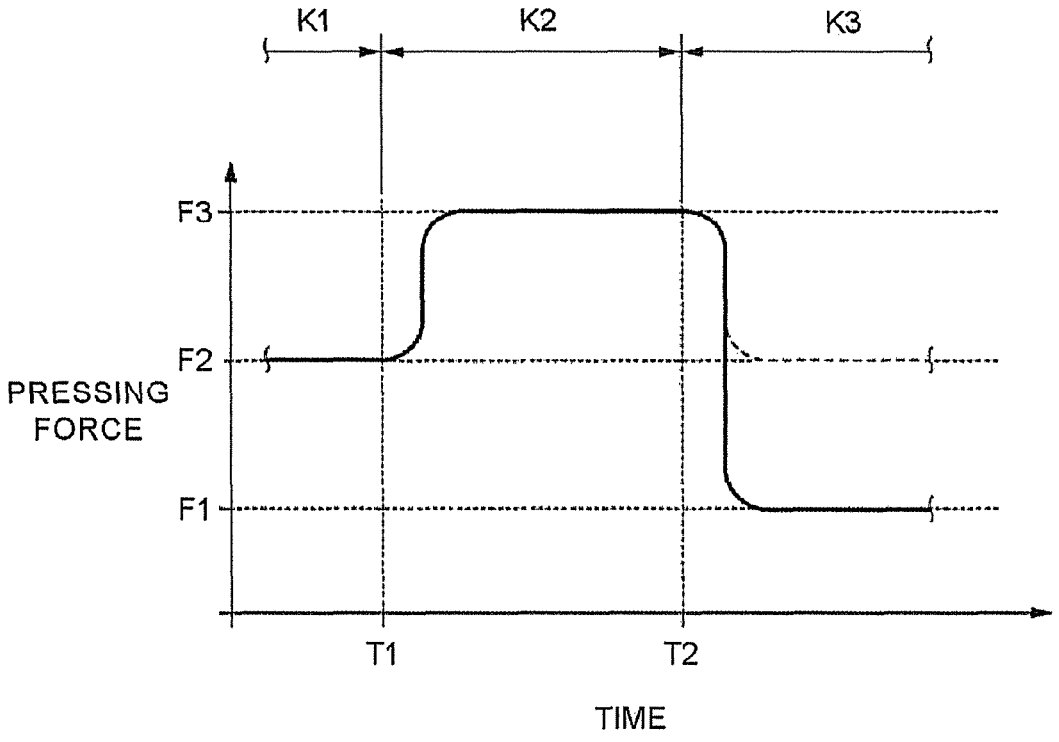
FIG. 9 is an illustration diagram illustrating the effect caused by the sheet folding mechanism according to the embodiment.

FIG. 9 is an illustration diagram illustrating the effect caused by the sheet folding mechanism 40 according to the embodiment. In FIG. 9, the horizontal axis represents 'time', and the vertical axis represents 'pressing force'. In FIG. 9, the symbol K1 represents a 'sheet folding preparation interval', the symbol K2 represents a 'sheet folding operation interval', and the symbol K3 represents a 'folded sheet conveyance interval'.

The sheet folding preparation interval K1 means a preparation interval prior to the folding of a sheet bundle 6 in half. The sheet folding operation interval K2 means an interval when a sheet bundle 6 is being folded in half. In other words, the sheet folding operation interval K2 means an interval when a sheet bundle 6 is started to be folded in half. The folded sheet conveyance interval K3 means an interval when a sheet bundle 6 folded in half is being conveyed.

The folding member 51 retracts from the nip section 40*a* in the sheet folding preparation interval K1 and the folded sheet conveyance interval K3. The folding member 51 enters the nip section 40*a* in the sheet folding operation interval K2.

The sheet folding mechanism 40 (refer to FIG. 3) provided with the pressing force adjusting mechanism 70 is hereinafter referred to as an 'example'. A sheet folding mechanism not provided with the pressing force adjusting mechanism 70 is hereinafter referred to as a ' comparative example'. In FIG. 9, the graph of the comparative example is indicated by a dotted line and that of the example is indicated by a solid line.

A comparative example is described first. As shown in FIG. 9, a given pressing force F2 is generated in the sheet folding preparation interval K1. In the sheet folding operation interval K2, the pressing force increases sharply from F2 to F3 and then remains at F3. In the folded sheet conveyance interval K3, the pressing force decreases sharply from F3 to F2 and then remains at F2.

The example is described below. A given pressing force F2 is generated in the sheet folding preparation interval K1. In the sheet folding operation interval K2, the pressing force increases sharply from F2 to F3 and then remains at F3.

Different from in the comparative example, in the example, in the folded sheet conveyance interval K3, the pressing force decreases sharply from F3 to F1 (<F2) and then remains at F1.

Further, in the sheet folding mechanism 40, a pressing force with a magnitude by means of which a sheet bundle 6 can be folded in half is necessarily applied to the nip section 40*a*. For example, as a method for applying a pressing force with a magnitude by means of which a sheet bundle 6 can be folded in half to the nip section 40*a*, a spring energizes the second roller 42 to the first roller 41. With the use of the spring energization, the pressing force applied to the nip section 40*a* can be usually kept at a constant with which a sheet bundle 6 can be folded in half. On the other hand, the pressing force of the nip section 40*a* at the time of conveyance of a sheet bundle 6 can be small as long as the pressing force is enough to convey the sheet bundle 6 folded in half. However, if kept at a constant with which the sheet bundle 6 can be folded in half, the pressing force of the nip section 40*a* when the sheet bundle 6 folded in half is conveyed may be too strong. As a consequence, the sheet bundle 6 folded in half may suffer a too large conveyance resistance when being conveyed, thus leading to problems such as the high power consumption of the motor 61.

According to the embodiment, the sheet folding mechanism 40 comprises the first roller 41, the second roller 42 and the pressing force adjusting mechanism 70. The second roller 42 is energized to the first roller 41. The second roller 42 and the first roller 41 form a nip section 40*a* therebetween together. The second roller 42, together with the first roller, folds a sheet bundle 6 in half through the nip section 40*a* and conveys the sheet bundle 6 folded in half. The pressing force adjusting mechanism 70 can increase or decrease the pressing force generated at the nip section 40*a*. The pressing force adjusting mechanism 70 causes a pressing force F1 in a state of being conveying the sheet bundle 6 folded in half to be lower than a pressing force K2 in a state of being folding the sheet bundle 6 in half, thus realizing the following effect: even if the second roller 42 is usually energized to the first roller 41, when compared with a case in which the pressing force adjusting mechanism 70 is not arranged, the pressing force applied to the nip section 40*a* to convey the sheet bundle 6 folded in half can be reduced in a case in which the pressing force adjusting mechanism 70 is arranged. Consequentially, when being conveyed, the sheet bundle 6 folded in half can suffer a lower conveyance resistance, thus lowering the energy consumption of the motor 61.

The pressing force adjusting mechanism 70 comprises the cam 45 for switching the relative position between the first roller 41 and the second roller 42. The relative position switched by the pressing force adjusting mechanism 70 includes a pressing force increase position at which a pressing force is increased relatively and a pressing force decrease position at which a pressing force is decreased relatively. The cam 45 comprises a first position regulation section 45*a* for setting the pressing force increase position and a second position regulation section 45*b* for setting the pressing force decrease position, thus realizing the following effect: because of the simple structure provided with the cam 45, the sheet folding mechanism 40 is simpler and cheaper than a sheet folding mechanism 40 provided with a rack and pinion mechanism.

The length L1 of the first position regulation section 45*a* in the circumferential direction of the cam 45 is shorter than the length L2 of the second position regulation section 45*b* in the circumferential direction of the cam 45 (L1<L2), thus realizing the following effect when compared with a case where the length L1 of the first position regulation section 45*a* is longer than the length L2 of the second position regulation section 45*b* (L1>L2): when rotating the cam 45 in synchronization with the first roller 41, the relative position can be switched between the pressing force increase position and the pressing force decrease position easily in accordance with the length of the sheet bundle 6 in the conveyance direction of the sheet bundle 6. Thus, the switching driving of the cam 45 can be controlled easily.

The cam 45 rotates around the same axis as the first roller 41, thus realizing the following effect when compared with a case where the cam 45 and the first roller 41 rotate around different axes: the sheet folding mechanism 40 is simplified and lowered in cost as it is not necessary to independently arrange a member to transfer a switching operation based on the cam 45.

The cam 45 rotates independently from the first roller 41, thus realizing the following effect when compared with a case where the cam 45 and the first roller 41 rotate integrally: as the relative position can be temporarily stopped in advance at the pressing force increase position or the pressing force decrease position, regardless of the length of a sheet bundle 6 in the conveyance direction of the sheet bundle 6, the energy consumption of the motor 61 can be lowered.

The first roller 41 rotates independently. The second roller 42 rotates with the rotation of the first roller 41, thus realizing the following effect when compared with a case where the first roller 41 and the second roller 42 rotate independently from each other: the sheet folding mechanism 40 is simplified and lowered in cost as it is not necessary to independently arrange a mechanism to drive the second roller 42.

The sheet folding mechanism 40 further comprises the folding member 51 which enters the nip section 40*a* to pushes a sheet bundle 6 into the nip section 40*a* and then retracts from the nip section 40*a*, thus realizing the following effect when compared with a case where the folding member 51 is not arranged: when to be folded in half, a sheet bundle 6 can be pushed into the nip section 40*a* by the folding member 51 and thus folded in half smoothly.

The pressing force adjusting mechanism 70 causes a pressing force in a state in which the folding member 51 is retracting from the nip section 40*a* to be lower than that in a state in which the folding member 51 is entering the nip section 40*a*, thus realizing the following effect: even if the second roller 42 is usually energized to the first roller 41, when compared with a case in which the pressing force adjusting mechanism 70 is not arranged, the pressing force applied to the nip section 40*a* to make the folding member 51 retract from the nip section 40*a* can be reduced in a case in which the pressing force adjusting mechanism 70 is arranged. Thus, when being retracted from the nip section 40*a*, the friction resistance to the folding member 51 can be reduced. As a result, the energy consumption of the motor 61 can be reduced.

The post-processing apparatus 3 comprises the foregoing sheet folding mechanism 40, and thus, the energy consumption of the motor 61 can be reduced further during the sheet folding processing.

A modification is described below.

For example, the cam 45 and the first roller 41 may rotate integrally. As the cam 45 and the first roller 41 rotate integrally, the following effect is realized when compared with a case where the cam 45 rotates independently from the first roller 41: by matching the length of the cam 45 in the circumferential direction of the cam 45 with the length of a sheet bundle 6 in the conveyance direction of the sheet bundle 6, as the cam 45 and the first roller 41 can be driven to rotate collectively, and the rotation driving of the cam 45 and the first roller 41 can be controlled easily. For example, the length of the cam 45 in the circumferential direction of the cam 45 is set so that a sheet bundle 6 is conveyed once every time the cam 45 rotates once. Further, the cam 45 and the first roller 41 can share the same drive source, thus simplifying the structure of the sheet folding mechanism 40 when compared with a case in which the drive sources of the cam 45 and the first roller 41 are arranged independently.

Not limited to fold a sheet bundle 6 in half together with the first roller 41 through the nip section 40*a* and then convey the sheet bundle 6 folded in half together with the first roller 41, the second roller 42 may fold a sheet 5 in half together with the first roller 41 through the nip section 40*a* and then convey the sheet 5 folded in half together with the first roller 41. That is, the object to be folded in half may be a sheet 5 or a sheet bundle 6. For example, the pressing force adjusting mechanism 70 may increase or decrease the pressing force generated at the nip section 40*a* in accordance with the thickness of a sheet 5 or a sheet bundle 6 (the number of sheets 5).

The pressing force adjusting mechanism 70 is not necessarily provided with a cam 45 for switching the relative position between the first roller 41 and the second roller 42. For example, the pressing force adjusting mechanism 70 may be provided with a rack and pinion mechanism. Further, the pressing force adjusting mechanism 70 may be a drive mechanism capable of separating the second roller 42 from the first roller 41.

According to at least one of the foregoing embodiments, a sheet folding mechanism 40 comprises a first roller 41, a second roller 42 and a pressing force adjusting mechanism 70. The second roller 42 is energized to the first roller 41. The second roller 42 and the first roller 41 form a nip section 40*a* therebetween together. The second roller 42, together with the first roller, folds a sheet bundle 6 in half through the nip section 40*a* and conveys the sheet bundle 6 folded in half. The pressing force adjusting mechanism 70 can increase or decrease the pressing force generated at the nip section 40*a*. The pressing force adjusting mechanism causes a pressing force F1 in a state of being conveying the sheet bundle 6 folded in half to be lower than a pressing force K2 in a state of being folding the sheet bundle 6 in half, thus realizing the following effect: when compared with a case where the pressing force adjusting mechanism 70 is not arranged: even if the second roller 42 is usually energized to the first roller 41, the pressing force applied to the nip section 40*a* to convey the sheet bundle 6 folded in half is lower than that in a case where the pressing force adjusting mechanism 70 is arranged. Consequentially, when being conveyed, the sheet bundle 6 folded in half can suffer a lower conveyance resistance, thus lowering the energy consumption of the motor 61.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A sheet folding apparatus, comprising:

a first roller;

a second roller configured to be energized to the first roller, form a nip section together with the first roller, fold a sheet in half together with the first roller through the nip section and convey the sheet folded in half together with the first roller; and a pressing force adjusting mechanism configured to be capable of increasing and decreasing a pressing force generated at the nip section and cause the pressing force in a state of conveying the sheet folded in half to be lower than that in a state of folding the sheet in half, the pressing force adjusting mechanism comprising a cam that switches a relative position between the first roller and the second roller, the cam comprising a first position regulation section that sets a pressing force increase position and a second position regulation section that sets a pressing force decrease position, wherein a pressing force of the pressing force increase position is relatively higher than a pressing force of the pressing force decrease position, wherein the cam and the first roller rotate coaxially.

2. The sheet folding mechanism according to claim 1, wherein the length of the first position regulation section in the circumferential direction of the cam is shorter than the length of the second position regulation section in the circumferential direction of the cam.

3. The sheet folding mechanism according to claim 1, wherein the cam rotates independently from the first roller.

4. The sheet folding mechanism according to claim 1, wherein the cam and the first roller rotate integrally.

5. The sheet folding mechanism according to claim 1, wherein the first roller rotates independently; and the second roller rotates with the rotation of the first roller.

6. The sheet folding mechanism according to claim 1, further comprising:

a folding member which enters the nip section to press the sheet into the nip section and then retracts from the nip section.

7. The sheet folding mechanism according to claim 6, wherein the pressing force adjusting mechanism causes the pressing force in a state in which the folding member is retracting from the nip section to be lower than that in a state in which the folding member is entering the nip section.

8. A sheet processing apparatus, comprising:

a discharging section configured to discharge a sheet conveyed from a conveyance path;

a first roller;

a second roller configured to be energized to the first roller, form a nip section together with the first roller, fold a sheet in half together with the first roller through the nip section and convey the sheet folded in half together with the first roller; and a pressing force adjusting mechanism configured to be capable of increasing and decreasing a pressing force generated at the nip section and cause the pressing force in a state of conveying the sheet folded in half to be lower than that in a state of folding the sheet in half, the pressing force adjusting mechanism comprising a cam that switches a relative position between the first roller and the second roller, the cam comprising a first position regulation section that sets a pressing force increase position and a second position regulation section that sets a pressing force decrease position, wherein a pressing force of the pressing force increase position is relatively higher than a pressing force of the pressing force decrease position, wherein the cam and the first roller rotate coaxially.

* * * * *